US012442180B2

(12) United States Patent
Gebhardt et al.

(10) Patent No.: US 12,442,180 B2
(45) Date of Patent: Oct. 14, 2025

(54) EXPANSION JOINT ASSEMBLY

(71) Applicant: InPro Corporation, Muskego, WI (US)

(72) Inventors: David R. Gebhardt, Milwaukee, WI (US); George M. Fisher, Waukesha, WI (US)

(73) Assignee: InPro Corporation, Muskego, WI (US)

( * ) Notice: Subject to any disclaimer, the term of this patent is extended or adjusted under 35 U.S.C. 154(b) by 272 days.

(21) Appl. No.: 18/457,737

(22) Filed: Aug. 29, 2023

(65) Prior Publication Data

US 2025/0075492 A1 Mar. 6, 2025

(51) Int. Cl.
*E04B 1/68* (2006.01)

(52) U.S. Cl.
CPC ..... *E04B 1/6815* (2013.01)

(58) Field of Classification Search
CPC ..... E04B 1/6815; E04B 1/7604; E04B 2001/7695
See application file for complete search history.

(56) References Cited

U.S. PATENT DOCUMENTS 3,448,552 A * 6/1969 Schmitt ..... E04B 1/6815 52/395
4,557,082 A * 12/1985 Dunsworth ..... E04B 1/6815 160/159
4,914,884 A * 4/1990 Ohmatsu ..... E04B 1/6815 404/47
5,067,297 A * 11/1991 Sobol ..... E04B 1/6815 52/396.05
6,581,347 B1 * 6/2003 Knak ..... E04F 15/02005 52/471
9,494,235 B2 11/2016 Winslow et al.
10,053,857 B1 8/2018 Gebhardt
10,858,826 B2 12/2020 Gebhardt et al.
12,146,316 B2 * 11/2024 Devlin ..... E01C 11/08
2003/0154677 A1 * 8/2003 Knak ..... E04B 1/6815 52/396.04
2015/0113745 A1 * 4/2015 Haydu ..... E01C 11/02 14/73.1
2019/0169836 A1 * 6/2019 Fisher ..... E04B 5/36
2020/0040568 A1 * 2/2020 Gebhardt ..... E04B 1/61

OTHER PUBLICATIONS

U.S. Appl. No. 62/714,392, filed Aug. 3, 2018, Gebhardt et al.

* cited by examiner

*Primary Examiner* — Joshua K Ihezie
(74) *Attorney, Agent, or Firm* — Reinhart Boerner Van Deuren s.c.

(57) ABSTRACT

Embodiments of an expansion joint are provided. The expansion joint is configured to cover a gap between a first architectural surface and a second architectural surface. The expansion joint includes a panel, subframe, first mounting joint, and a second mounting joint. The second mounting joint includes a coupling member, mounting frame, and clamping arm, each, respectively, being continuous and integrally formed components. The second mounting joint releasably attaches the expansion joint to the second architectural surface. In this way, the expansion joint can be easily removed from the second architectural surface. The expansion joint may also include a slide assembly capable of moving laterally within the subframe and/or an extension arm configured to extend the subframe of the expansion joint to keep the panel from dislodging from the architectural surfaces in response to seismic activity and/or other large expansions or contractions between architectural gaps.

20 Claims, 6 Drawing Sheets

EXPANSION JOINT ASSEMBLY

BACKGROUND OF THE INVENTION

The present invention relates generally to the field of architectural joints. The present invention relates specifically to an expansion joint configured to cover a gap between roof, wall, ceiling, and/or floor sections in a building.

In a building, gaps are provided between sections of roofs, walls, ceilings, and/or floors to compensate for the expansion and contraction of a building as a result of temperature, seismic activity, sway from the wind, and deflection resulting from static or live loads. Such gaps are generally covered using expansion joints for both safety and aesthetic reasons. Embodiments of the present invention relate to expansion joints.

SUMMARY OF THE INVENTION

One embodiment of the invention relates to an expansion joint for covering a gap between a first architectural surface and a second architectural surface. The expansion joint includes a panel, a subframe, a first mounting joint, and a second mounting joint. The subframe is coupled to the panel and includes a plurality of beams. The plurality of beams extend in a lateral direction and are spaced apart from each other in a transverse direction. The first mounting joint is configured to attach to the first architectural surface and includes a first mounting frame. The second mounting joint is configured to attach to the second architectural surface and includes a coupling member, a second mounting frame, and a clamping arm. The clamping arm is coupled to the second mounting frame. The second mounting frame and the clamping arm are configured to releasably couple to the coupling member. Each of the coupling member, the second mounting frame, and the clamping arm, respectively, are continuous integrally formed components that extend to each of the plurality of beams.

Another embodiment of the invention relates to an expansion joint for covering a gap between a first architectural surface and a second architectural surface. The expansion joint includes a panel, a subframe, a first mounting joint, and a second mounting joint. The subframe is coupled to the panel and includes a plurality of beams. The plurality of beams extend in a lateral direction and are spaced apart from each other in a transverse direction. The first mounting joint is configured to attach to the first architectural surface and includes a first mounting frame. The second mounting joint includes a coupling member, a second mounting frame, and a clamping arm. The coupling member is coupled to the subframe. The second mounting frame is configured to attach to the second architectural surface. The clamping arm is coupled to the second mounting frame. Each of the coupling member, the second mounting frame, and the clamping arm, respectively, are continuous integrally formed components that extend to each of the plurality of beams.

Another embodiment of the invention relates to an expansion joint for covering a gap between a first architectural surface and a second architectural surface. The expansion joint includes a panel, a subframe, a first mounting joint, and a second mounting joint. The subframe is coupled to the panel and includes a plurality of beams. The plurality of beams extend in a lateral direction and are spaced apart from each other in a transverse direction. The first mounting joint is configured to attach to the first architectural surface and includes a first mounting frame. The second mounting joint is configured to attach to the second architectural surface and includes a coupling member, a second mounting frame, and a clamping arm. The clamping arm is coupled to the second mounting frame. Each of the coupling member, the second mounting frame, and the clamping arm, respectively, are continuous integrally formed components that extend to each of the plurality of beams. The expansion joint is adjustable between a closed position and a disengaged position. When the expansion joint is in the closed position, the coupling member is releasably coupled to each of the coupling member, the second mounting frame, and the clamping arm. When the expansion joint is in the disengaged position, the coupling member is capable of movement relative to the second mounting frame. In a specific embodiment, the first mounting frame defines a rotational axis. When the expansion joint is in the disengaged position, the subframe is configured to rotate about the rotational axis.

Another embodiment of the invention relates to an expansion joint for covering a gap between a first architectural surface and a second architectural surface. The expansion joint includes a panel, a subframe, a first mounting joint, and a second mounting joint. The subframe is rigidly coupled to the panel and includes a mounting rail. The mounting rail extends in a lateral direction. The first mounting joint is configured to attach to the first architectural surface. The second mounting joint is configured to attach to the second architectural surface and is slidably coupled to the mounting rail. The second mounting joint can slide in the lateral direction relative to the subframe such that a distance between the first mounting joint and the second mounting joint can vary between 0 inches and 120 inches. In a specific embodiment, the subframe includes a bracket extending in the lateral direction and an extension arm. The extension arm is slidably coupled and received within the bracket such that the extension arm and bracket have a telescoping relationship. The extension arm is adjustable between a retracted position and an extended position. When the extension arm is in the retracted position, the subframe has a first length in the lateral direction. When the extension arm is in the extended position, the subframe has a second length in the lateral direction that is about twice the first length.

Additional features and advantages will be set forth in the detailed description which follows, and, in part, will be readily apparent to those skilled in the art from the description or recognized by practicing the embodiments as described in the written description and claims thereof, as well as the appended drawings. It is to be understood that both the foregoing general description and the following detailed description are exemplary.

The accompanying drawings are included to provide further understanding and are incorporated in and constitute part of the specification. The drawings illustrate one or more embodiment, and together with the description serve to explain the principles and operation of various embodiments.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of an expansion joint are shown. Embodiments of the expansion joint discussed herein include an innovative mounting design to provide for a variety of desired characteristics, including releasable attachment of the expansion joint to a roof, wall, ceiling, and/or floor section, reduced manufacturing costs, and/or relative motion of a mounting joint within the expansion joint to accommodate expansions, contractions, and/or vertical displacement between architectural gaps. Typically, traditional expansion joints are mounted to architectural surfaces via substantially fixed means of attachment. In order to inspect installations of and adjacent to traditional expansion joints, users typically must expend significant time and effort to disassemble portions of the expansion joint.

Applicant has found it beneficial to provide an expansion joint having a releasable mounting joint including several continuous and integrally formed components that span a substantial width of the expansion joint to releasably attach the expansion joint to an architectural surface to secure a panel over a gap between sections of a roof, ceiling, floor, and/or wall. This allows users to easily release the expansion joint from an architectural surface to inspect underlying installations. The continuous and integrally formed components of the mounting joint provide secure attachment of the expansion joint to an architectural surface while also providing a structure that can reduce costs of installation relative to assembling additional components. In some embodiments, the mounting joint includes one or more slide assemblies capable of moving laterally within a subframe of the expansion joint and/or an extension arm configured to extend the subframe of the expansion joint to keep the panel from dislodging from the roof, ceiling, floor, and/or wall sections in response to seismic activity and/or other large expansions or contractions between architectural gaps.

Figure 1:
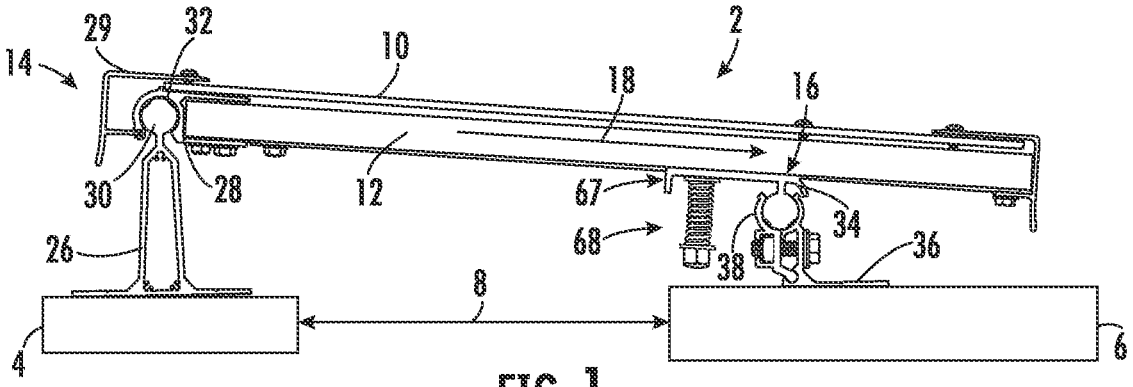
FIG. 1 is a side view of an expansion joint assembly, according to an exemplary embodiment.

Referring to FIG. 1, a side view of an expansion joint assembly 2 attached to a first architectural surface 4 and a second architectural surface 6 is shown according to an exemplary embodiment. Expansion joint assembly 2 covers a gap 8 between first architectural surface 4 and second architectural surface 6. Expansion joint assembly 2 includes a panel 10, a subframe 12, a first mounting joint 14, and a second mounting joint 16.

In a specific embodiment, subframe 12 is coupled to first mounting joint 14 and second mounting joint 16. Subframe 12 defines a lateral direction 18 that extends along a length of subframe 12 between first mounting joint 14 and second mounting joint 16, when subframe 12 is coupled to both first mounting joint 14 and second mounting joint 16. First mounting joint 14 is attached to first architectural surface 4 and second mounting joint 16 is attached to second architectural surface 6, such that subframe 12 extends over gap 8 in the lateral direction 18 when subframe 12 is coupled to both first mounting joint 14 and second mounting joint 16. Expansion joint assembly 2 can also include a vapor barrier between first mounting joint 14 and first architectural surface 4 and between second mounting joint 16 and second architectural surface 6 that extends over gap 8. In a specific embodiment, the vapor barrier is a reinforced ethylene propylene diene monomer (EPDM) vapor barrier. Alternatively, the vapor barrier could be formed from thermoplastic polyolefin or polyvinyl chloride.

As shown in FIG. 1, Panel 10 is coupled to a side of subframe 12. In some embodiments, the point at which the subframe 12 contacts the second mounting joint 16 has a lower altitude than the point at which the subframe 12 contacts the first mounting joint 14 such that panel 10 is sloped downward in the lateral direction toward the second mounting joint. Applicant has found that a downward slope of panel 10 reduces the buildup of standing water on panel 10 when panel 10 is positioned generally horizontally and exposed to outdoor conditions. In some embodiments, Panel 10 includes a continuous cover pan assembly. Cover pan assembly includes a bottom section and two side sections arranged perpendicularly to the bottom section. Further, the side section defines a depth of the cover pan assembly, which in embodiments is from 5 mm to 100 mm, from 10 mm to 50 mm, or from 15 mm to 25 mm. Alternatively, panel 10 may be a single integral piece. Panel 10 can be formed from composite materials. In a specific embodiment, panel 10 is a fire and dent resistant resin coated composite panel. In some embodiments, panel 10 is composed of a metal alloy, wood, asphalt shingle, and/or other common roofing materials. According to some embodiments, Panel 10 has a length in the lateral direction 18 of between 4 and 60 inches. In other embodiments, Panel 10 has a length in the lateral direction 18 that is greater than 60 inches. In a specific embodiment, Panel 10 has a length in the lateral direction 18 of about 19 inches.

First mounting joint 14 includes a first mounting frame 26, a receiving bracket 28, and a trim cover 29. First mounting frame 26 is securely attached to first architectural surface 4. In a specific embodiment, first mounting frame 26 is rigidly coupled to first architectural surface 4 by a plurality of sheet metal screws. First mounting frame 26 includes a generally cylindrical first coupling member 30 having a convex arcuate surface with a first radius of curvature. First mounting frame 26 is coupled to receiving bracket 28. Receiving bracket 28 includes a channel 32 having a radius of curvature that corresponds to the first radius of curvature such that the generally cylindrical first coupling member 30 fits within channel 32 when receiving bracket 28 is coupled to first mounting frame 26. In some embodiments, the radius of curvature of channel 32 is within 5%, 3%, 2%, or 1% of the radius of curvature of the generally cylindrical first coupling member 30. Receiving bracket 28 receives and rigidly couples to a portion of subframe 12. Trim cover 29 is coupled to receiving bracket 28 and panel 10 such that trim cover 29 overhangs and covers a portion of first mounting joint 14. In a specific embodiment, trim cover 29 is formed from aluminum through an extrusion process and includes a clear anodized finish. In an alternative embodiment, expansion joint assembly 2 does not include a trim cover 29, and Panel 10 includes a downturned edge that overhangs and covers a portion of first mounting joint 14.

Second mounting joint 16 includes a second coupling member 34, a second mounting frame 36, and a clamping arm 38. In a specific embodiment, second coupling member 34, second mounting frame 36, and/or clamping arm 38 are formed from aluminum through an extrusion process. Second mounting frame 36 rigidly couples to second architectural surface 6 such that second mounting frame 36 is in direct contact with second architectural surface 6. In some embodiments, second mounting frame 36 is rigidly coupled to the second architectural surface 6 by a plurality of fasteners appropriate for the substrate of second architectural surface 6. Second coupling member 34 is coupled to and in direct contact with subframe 12. Second coupling member 34 also couples to second mounting frame 36 and clamping arm 38 to securely attach subframe 12 to second architectural surface 6.

First architectural surface 4 and second architectural surface 6 are architectural surfaces such as sections of a wall, roof, ceiling, or floor. In a specific embodiment, first architectural surface 4 and second architectural surface 6 are the same type of architectural surface (e.g. both are roof sections, or both are wall section, etc.). Alternatively, first architectural surface 4 and second architectural surface 6 can be sections of different types of architectural surfaces (e.g. a wall and a roof, a floor and a wall, etc.).

Figure 2:
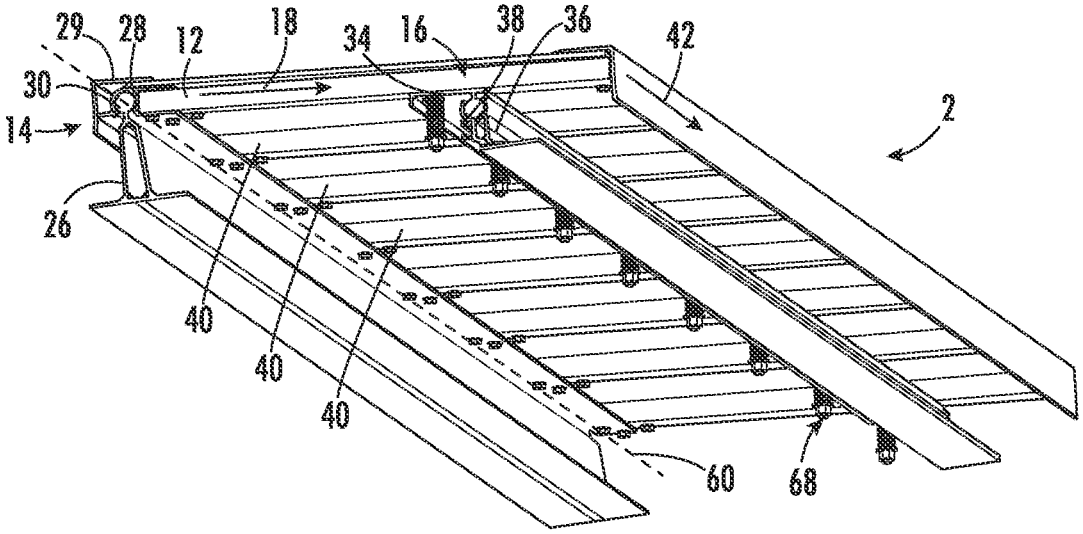
FIG. 2 is a bottom perspective view of the expansion joint assembly of FIG. 1, according to an exemplary embodiment.

Referring to FIG. 2, a bottom perspective view of expansion joint assembly 2 is shown, according to an exemplary embodiment. As shown in FIG. 2, subframe 12 includes a plurality of beams 40 extending in the lateral direction 18. Beams 40 are spaced apart from each other. In some embodiments, beams 40 are substantially parallel to each other and spaced apart from each other in a transverse direction 42 that is perpendicular to the lateral direction 18. Beams 40 can be formed from aluminum through an extrusion process.

As shown in FIG. 2, first mounting joint 14 and second mounting joint 16 extend across substantially an entire width of subframe 12 in the transverse direction 42. Specifically, first mounting joint 14 and second mounting joint 16 extend to, between and/or across at least two of the plurality of beams 40. In an exemplary embodiment, first mounting joint 14 and second mounting joint 16 extend to, between and/or across each of the plurality of beams 40. In some embodiments, first mounting frame 26, receiving bracket 28, trim cover 29, and/or first coupling member 30, respectively, are each single continuous integral components that extend the entire width of the first mounting joint 14 in the transverse direction 42. Similarly, in some embodiments, second coupling member 34, second mounting frame 36, and/or clamping arm 38, respectively, are each single integral components that extend the entire width of second mounting joint 16 in the transverse direction 42. Alternatively, any of first mounting frame 26, receiving bracket 28, trim cover 29, first coupling member 30, second coupling member 34, second mounting frame 36, and/or clamping arm 38 may be a plurality of discontinuous components that span the width of the first mounting joint 14 and/or the second mounting joint 16 at regular or irregular intervals. In an alternative embodiment, first coupling member 30 and/or second coupling member 34 include a plurality of spherical protrusions or discrete truncated cylindrical protrusions spaced apart from each other in the transverse direction 42 for coupling to first mounting frame 26 and second mounting frame 36, respectively. Each of first mounting frame 26, receiving bracket 28, trim cover 29, first coupling member 30, second coupling member 34, second mounting frame 36, and/or clamping arm 38 can be fabricated from aluminum and/or formed via aluminum extrusion.

Figure 3:
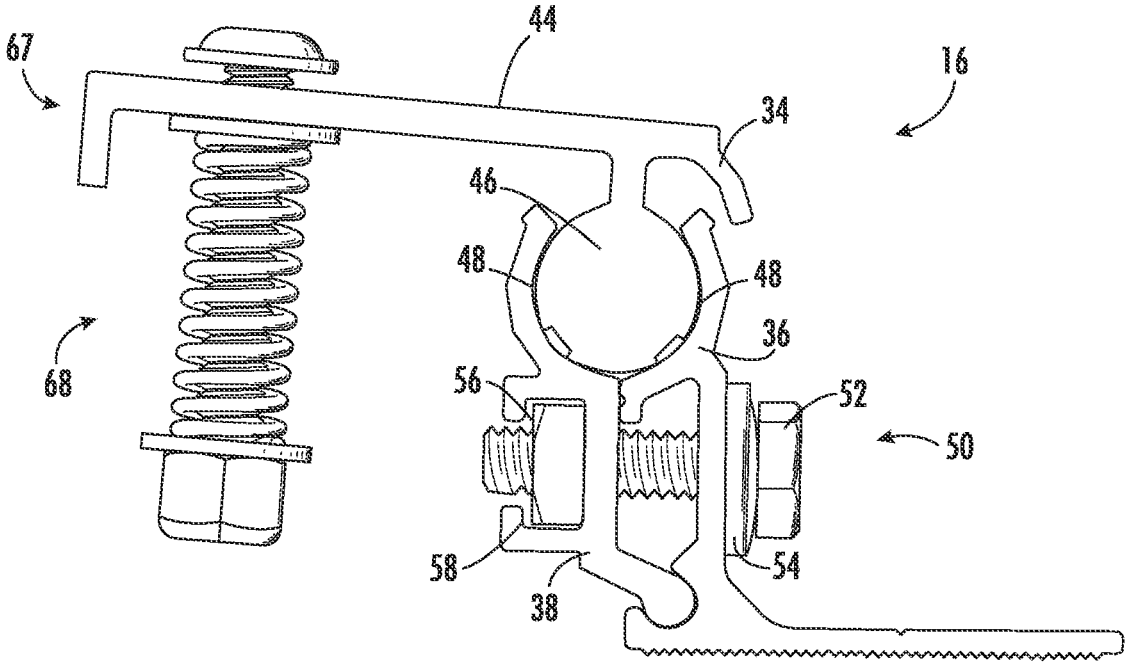
FIG. 3 is a detailed view of a mounting joint of the expansion joint assembly of FIG. 1, according to an exemplary embodiment.

Referring to FIG. 3, a detailed side view of second mounting joint 16 of expansion joint assembly 2 is shown, according to an exemplary embodiment. Second coupling member 34 includes an engagement surface 44 and a generally cylindrical protrusion 46. Engagement surface 44 directly contacts subframe 12. Cylindrical protrusion 46 directly contacts second mounting frame 36 and clamping arm 38 when second coupling member 34 is coupled to second mounting frame 36 and clamping arm 38. Cylindrical protrusion 46 has a convex arcuate surface having a second radius of curvature. Second mounting frame 36 and clamping arm 38 each include concave arcuate surfaces 48 having radii that correspond to the second radius of curvature such that cylindrical protrusion 46 fits between second mounting frame 36 and clamping arm 38 when second coupling member 34 is coupled to second mounting frame 36. In some embodiments, the radius of curvature of arcuate surfaces 48 are within 5%, 3%, 2%, or 1% of the second radius of curvature of cylindrical protrusion 46. Applicant has found that the correspondence of the second radius of curvature and the radius of curvature of arcuate surfaces 48 allows for second coupling member 34 to rotate relative to second mounting frame 36 and clamping arm 38 to accommodate different angles of attachment that may result following displacement of the second architectural surface 6 relative to the first architectural surface 4 due to seismic activity or other expansions or contractions of architectural structures. Second mounting frame 36 and clamping arm 38 only partially extend around cylindrical protrusion 46 and do not entirely surround cylindrical protrusion 46 to further accommodate rotation of second coupling member 34 relative to second mounting frame 36 and clamping arm 38.

As shown in FIG. 3, second mounting joint 16 includes a clamp fastening system 50. Clamp fastening system 50 includes a plurality of screws 52, a plurality of washers 54, and a plurality of square nuts 56. Clamping arm 38 includes a fastener channel 58 that receives the plurality of square nuts 56. Clamp fastening system 50 is configured such that tightening the screws 52 and square nuts 56 produces a coupling force between second mounting frame 36 and clamping arm 38. In a specific embodiment, clamping arm 38 is pivotally coupled to second mounting frame 36, such that tightening clamp fastening system 50 causes clamping arm 38 to rotate relative to second mounting frame 36.

Alternatively, second mounting joint 16 can be configured such that clamp fastening system 50 causes clamping arm 38 to move translationally relative to second mounting frame 36. Clamp fastening system 50 can be adjusted to set second mounting joint 16 in a disengaged position by loosening screws 52 and square nuts 56, resulting in an increased distance between arcuate surfaces 48 of second mounting frame 36 and clamping arm 38 such that second coupling member 34 can be disengaged and removed from second mounting frame 36 and clamping arm 38. Further, clamp fastening system 50 can be adjusted to set second mounting joint 16 in a closed position by tightening the screws 52 and square nuts 56 such that second coupling member 34 is coupled to second mounting frame 36 and clamping arm 38 such that subframe 12 is coupled to each of second coupling member 34, second mounting frame 36, and clamping arm 38. As such, clamp fastening system 50 releasably couples second mounting frame 36 and clamping arm 38 to second coupling member 34.

Figure 4:
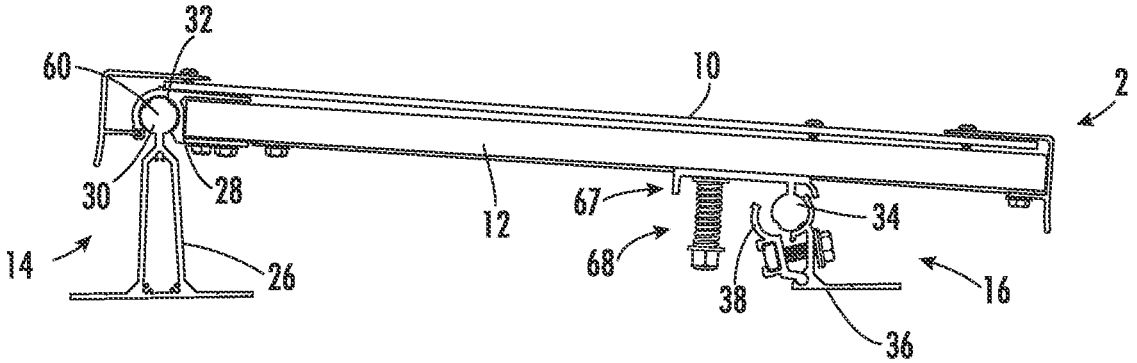
FIG. 4 is a side view of an expansion joint assembly including a mounting joint in a disengaged position, according to an exemplary embodiment.
Figure 5:
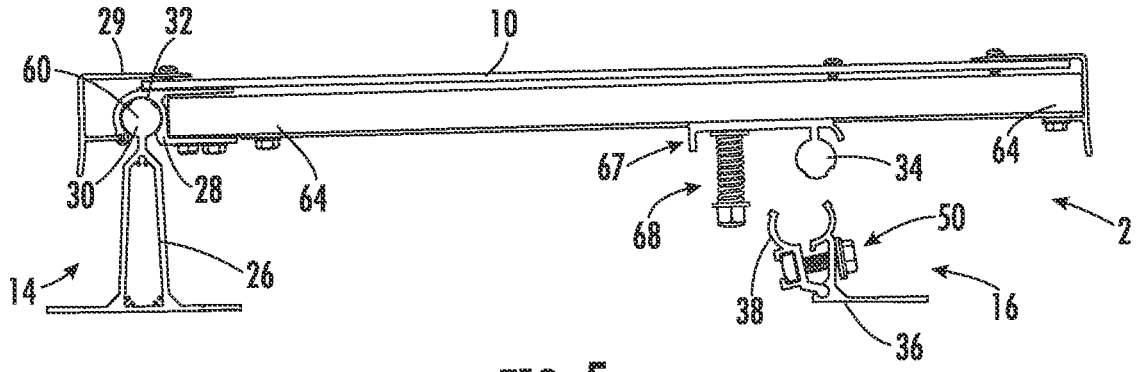
FIG. 5 is a side view of an expansion joint assembly is a disengaged position, according to an exemplary embodiment.
Figure 6:
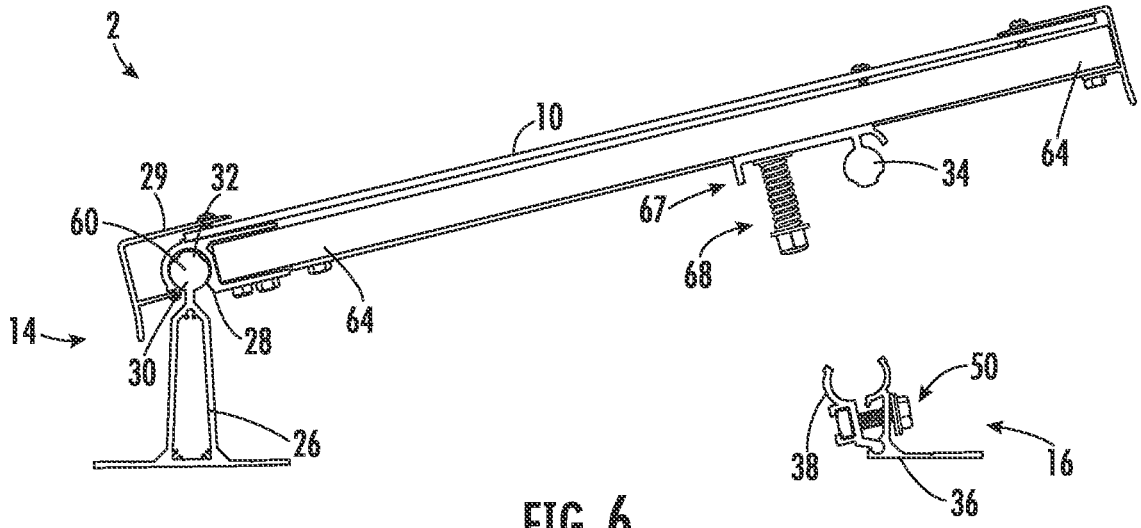
FIG. 6 is a side view of an expansion joint assembly in a disengaged position, according to an exemplary embodiment.

Referring to FIGS. 4-6, side views of expansion joint assembly 2 where second mounting joint 16 is in a disengaged position are shown, according to an exemplary embodiment. As shown in FIGS. 4-6, channel 32 of receiving bracket 28 is configured to allow receiving bracket to rotate about generally cylindrical first coupling member 30. As such, the central axis of the generally cylindrical first coupling member 30 defines a rotational axis 60. When second mounting joint 16 is in a disengaged position, subframe 12 can rotate about rotational axis 60 relative to first mounting frame 26. As shown in FIGS. 5 and 6, second coupling member 34 can be detached from second mounting frame 36 and clamping arm 38 by rotating subframe 12 about rotational axis 60. Applicant has found that rotation of subframe 12 when second mounting joint 16 is in a disengaged position allows users to easily inspect installations of and around second mounting joint 16 on and adjacent to second architectural surface 6, architectural surface 4, and gap 8.

Figure 7:
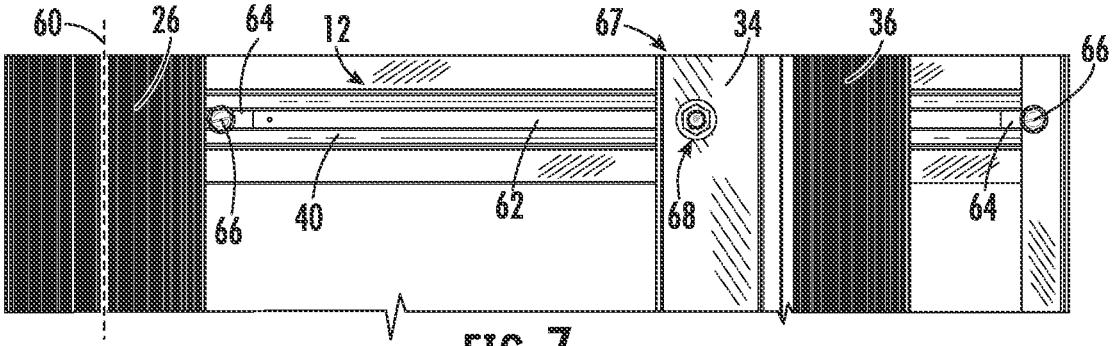
FIG. 7 is a detailed bottom view of the expansion joint assembly of FIG. 1, according to an exemplary embodiment.

Referring to FIG. 7, a detailed bottom view of expansion joint assembly 2 is shown, according to an exemplary embodiment. Beams 40 of subframe 12 include mounting rails 62 that provide a channel within beams 40 that extend substantially in the lateral direction 18. Beams 40 include stops 64 at each end in the lateral direction 18 within mounting rails 62. Stops 64 are rigidly coupled to beams 40 by fasteners 66.

Figure 8:
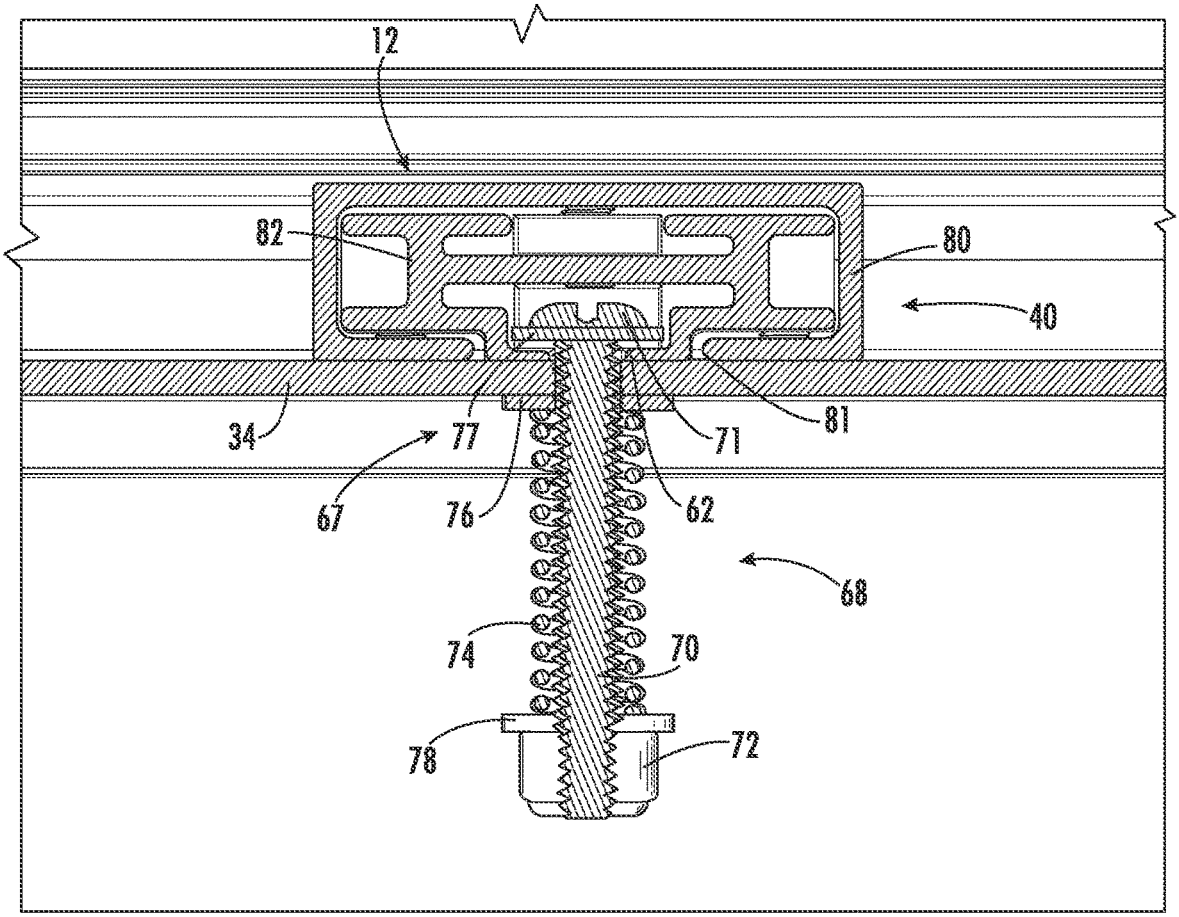
FIG. 8 is a cross-sectional view of a subframe of an expansion joint assembly, according to an exemplary embodiment.

Referring to FIG. 8, a partial, cross-sectional view of subframe 12 of expansion joint assembly 2 is shown, according to an exemplary embodiment. Second mounting joint 16 includes a lateral slide assembly 67 having a mounting fastener system 68. The mounting fastener system 68 includes biasing screws 70, nuts 72, biasing elements 74, upper washers 76, and lower washers 78. In a specific embodiment, biasing elements 74 are springs. Biasing elements 74 are disposed around biasing screws 70 and between an upper washer 76 and a lower washer 78. Biasing screws 70 include a screw head 71 at an upper end of biasing screws 70. Nuts 72 are coupled to threads of biasing screws 70 at a lower end of biasing screws 70 such that lower washer 78, biasing element 74 and upper washer 76 are disposed between screw head 71 and nut 72. Biasing screws 70 pass through second coupling member 34 and into mounting rails 62 of beams 40 such that a portion of subframe 12 and a portion of second coupling member 34 are disposed between screw head 71 and upper washer 76. Mounting fastener system 68 includes screw head washers 77 disposed between screw head 71 and a portion of subframe 12. In a specific embodiment, screw head washers 77 are plastic self-lubricating washers.

By tightening nut 72 on biasing screw 70, the distance between lower washer 78 and upper washer 76 is reduced, thereby compressing biasing element 74. As biasing element 74 is compressed, biasing element 74 exerts an upward force on upper washer 76 and a downward force on lower washer 78. The upward force on upper washer 76 is transferred to the second coupling member 34, creating an upward force on second coupling member 34 toward subframe 12. The downward force on lower washer 78 is transferred to biasing screw 70 via nut 72, such that screw head 71 exerts a downward force on subframe 12 toward second coupling member 34. As such, the mounting fastener system 68 produces variable coupling forces between second coupling member 34 and subframe 12. Applicant has found that the coupling forces produced by mounting fastener system 68 securely attach second coupling member 34 to subframe 12 and result in increased frictional forces between second coupling member 34 and subframe 12, thereby providing resistance to lateral motion of second coupling member 34 relative to subframe 12.

As shown in FIG. 8., beams 40 include a channel bracket 80 and an extension arm 82. Channel bracket 80 and extension arm 82 are substantially parallel to each other and extend in the lateral direction 18. Extension arm 82 is slidably coupled to and within channel bracket 80. Mounting rail 62 is located on extension arm 82, and channel bracket 80 includes an opening 81 that coincides with mounting rail 62 to allow biasing screws 70 to pass through mounting rail 62.

Figure 9:
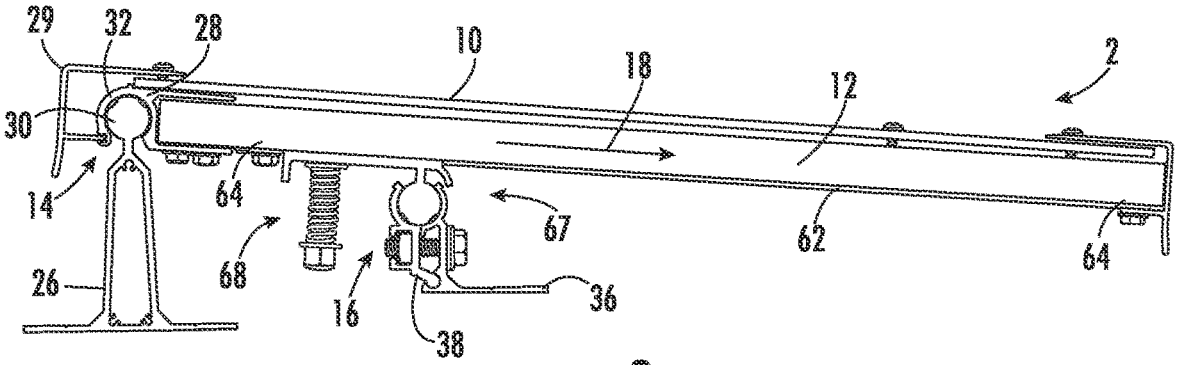
FIG. 9 is a side view of an expansion joint assembly including a lateral slide assembly in a retracted position, according to an exemplary embodiment.
Figure 10:
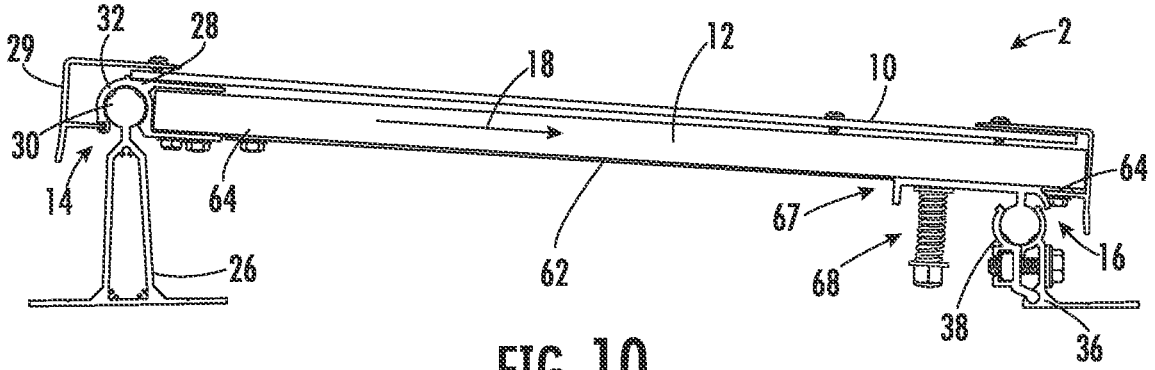
FIG. 10 is a side view of an expansion joint assembly including a lateral slide assembly in an extended position, according to an exemplary embodiment.

Referring to FIGS. 9 and 10, side views of expansion joint assembly 2 with lateral slide assembly 67 in various positions of retraction and extension are shown, according to an exemplary embodiment. Lateral slide assembly 67 is configured to slide or translate relative to mounting rail 62 in the lateral direction 18. In a specific embodiment, lateral slide assembly 67 can move along the entire length of mounting rail 62 between the stops 64 located at each end of mounting rail 62. Applicant has found that the lateral movement of lateral slide assembly 67 relative to mounting rail 62 allows subframe 12 to remain securely attached to both first mounting joint 14 and second mounting joint 16 in the event that the distance between first architectural surface 4 and second architectural surface 6 changes in response to seismic activity and/or other large expansions or contractions.

As shown in FIG. 9, lateral slide assembly 67 can be adjusted to a retracted position such that first mounting joint 14 and second mounting joint 16 are in close proximity to each other. In a specific embodiment, the distance between first mounting joint 14 and second mounting joint 16 is about 2.75 inches when lateral slide assembly 67 is in a fully retracted position, i.e. in contact with the stop 64 positioned closest to first mounting joint 14 and extension arm 82 is in a fully retracted position. Alternatively, the distance between first mounting joint 14 and second mounting joint 16 can be any of about 0, 1, 2, 3, 4, 5, or 6 inches when lateral slide assembly 67 is in a fully retracted position and extension arm 82 is in a fully retracted position.

As shown in FIG. 10, lateral slide assembly 67 can be adjusted to an extended position such that first mounting joint 14 and second mounting joint 16 are spaced relatively far apart from each other. In a specific embodiment, the distance between first mounting joint 14 and second mounting joint 16 is about 16 inches when lateral slide assembly 67 is in a fully extended position, i.e. in contact with the stop 64 positioned closest to second mounting joint 16 and extension arm 82 is in a fully retracted position. Alternatively, the distance between first mounting joint 14 and second mounting joint 16 can be any value between about 6 inches and about 60 inches when lateral slide assembly 67 is in a fully extended position and extension arm 82 is in a fully retracted position. Lateral slide assembly 67 is configured to move or slide in the lateral direction 18 within mounting rail 62 to any position between the fully retracted position and the fully extended position.

Figure 11:
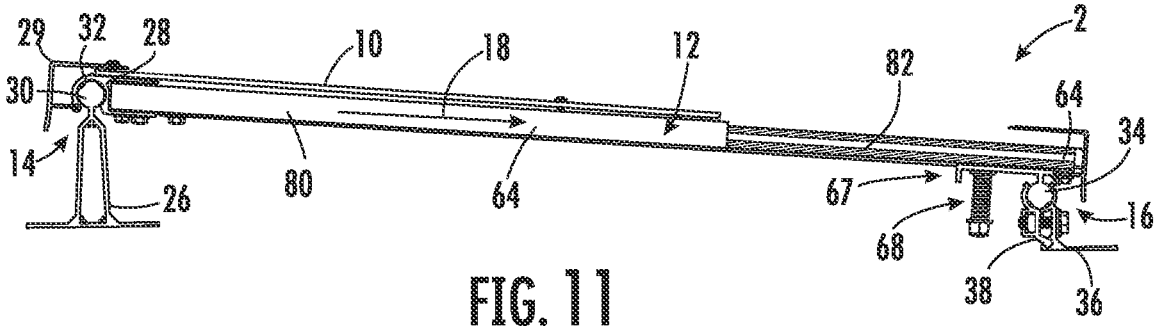
FIG. 11 is a side view of an expansion joint assembly including a lateral slide assembly in an extended position and an extension arm in an extended position, according to an exemplary embodiment.

Referring to FIG. 11, a side view of expansion joint assembly 2 with lateral slide assembly 67 in a fully extended position and extension arm 82 in an extended position is shown, according to an exemplary embodiment. Extension arm 82 slides or translates relative to channel bracket 80 in the lateral direction 18 between a fully retracted position and a fully extended position. In a specific embodiment, the length of subframe 12 in the lateral direction 18 is about 12 inches when extension arm 82 is in the fully retracted position and about 24 inches when extension arm 82 is in the fully extended position. In alternative embodiments, the length of subframe 12 in the lateral direction 18 is any of about 6, 8, 9, 10, 11, 13, 14, 15, 16 or 18 inches when extension arm 82 is in the fully retracted position, and any of about 18, 20, 21, 22, 23, 25, 26, 27, 28, or 30 inches when extension arm 82 is in the fully extended position. In a specific embodiment, extension arm 82 allows second mounting joint 16 to travel outward such that, when extension arm 82 is in the fully extended position, the total length of expansion joint assembly 2 in the lateral direction 18 is twice that of the length of expansion joint assembly 2 in the lateral direction 18 when extension arm 82 is in the fully retracted position.

Figure 12:
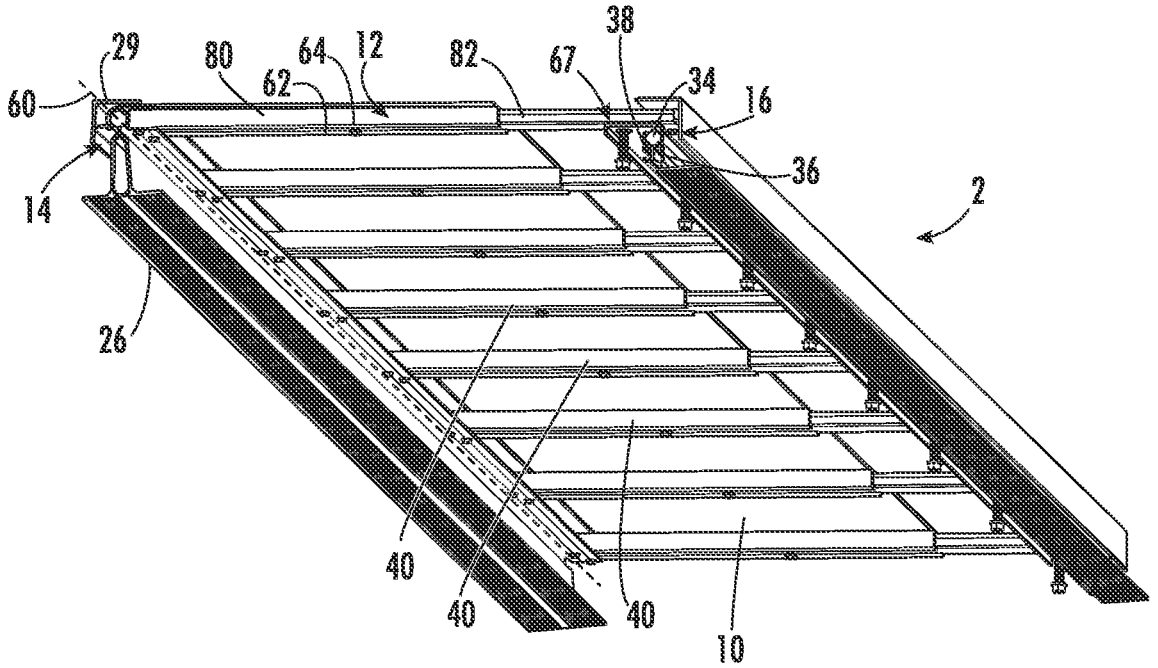
FIG. 12 is a bottom perspective view of the expansion joint assembly of FIG. 9, according to an exemplary embodiment.
Figure 13:
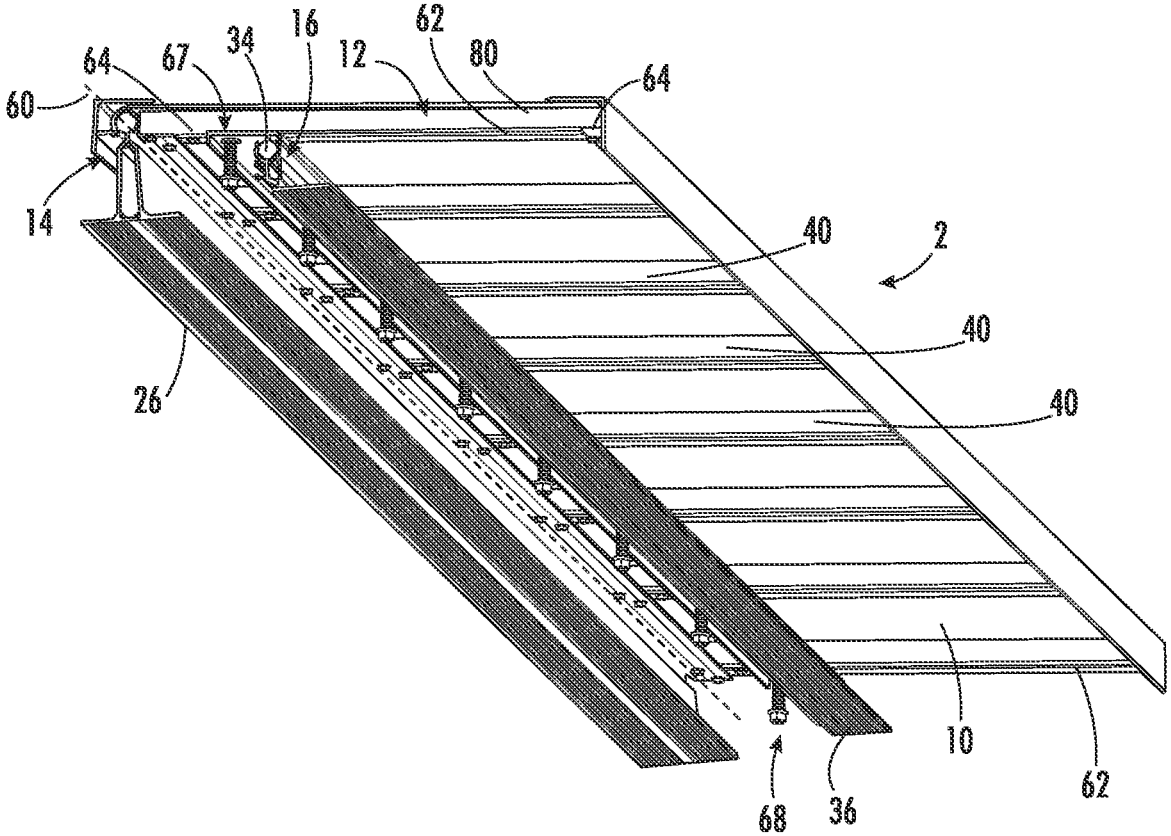
FIG. 13 is a bottom perspective view of the expansion joint assembly of FIG. 7, according to an exemplary embodiment.

Referring to FIGS. 12 and 13, perspective views of expansion joint assembly 2 with lateral slide assembly 67 and extension arms 82 in extended positions and in retracted positions, respectively, are shown according to an exemplary embodiment. As shown in FIG. 12, extension arms 82 are partially retained within and surrounded by channel brackets 80 and extend out of channel brackets 80 such that extension arms 82 and channel brackets 80 have a telescoping relationship. As shown in FIGS. 12 and 13, the telescoping relationship of extension arms 82 and channel brackets 80 and the sliding movement of lateral slide assembly 67 within mounting rail 62 allows for subframe 12 to maintain secure attachment to both first mounting joint 14 and second mounting joint 16 through a wide range of distances between first architectural surface 4 and second architectural surface 6. In a specific embodiment, the distance between first mounting joint 14 and second mounting joint 16 can vary between about 2.75 inches and 22 inches. Alternatively, the distance between first mounting joint 14 and second mounting joint 16 can vary between a minimum distance of any of about 1, 2, 3, 4, 5, or 6 inches and a maximum distance of any of about 6, 7, 8, 9, 10, 11, 12, 13, 14, 15, 16, 17, 18, 19, 20, 24, 26, 28, 30, 35, 40, 45, 50, 55, 60, 65, 70, 80, 90, 100, 110 or 120 inches.

Referring back to FIG. 1, a method for installing expansion joint assembly 2 includes securely attaching first mounting frame 26 to first architectural surface 4 and second mounting frame 36 to second architectural surface 6. A vapor barrier can be set in a continuous bead of sealant such that the vapor barrier extends between the first architectural surface 4 and the second architectural surface 6 and is coupled between the first mounting frame 26 and the first architectural surface 4 and between the second mounting frame 36 and the second architectural surface 6. Subframe 12 is pivotally coupled to first mounting frame 26. In a specific embodiment, expansion joint assembly 2 is substantially preassembled when subframe 12 is coupled to first mounting frame 26 such that panel 10, receiving bracket 28, trim cover 29, lateral slide assembly 67 and/or extension arms 82 are coupled to subframe 12 prior to pivotally coupling subframe 12 to first mounting frame 26. Subframe 12 is rotated about rotational axis 60 of first mounting frame 26 until lateral slide assembly 67 and second coupling member 34 are received by second mounting frame 36 and clamping arm 38. Second mounting joint 16 is then adjusted to the closed position to releasably couple second coupling member 34 to second mounting frame 36 and clamping arm 38. Second mounting joint 16 can then be adjusted to the disengaged position and subframe 12 rotated about rotational axis 60 to open the expansion joint assembly 2 and inspect installations of and around second mounting joint 16.

For purposes of this disclosure, the term "about," when referring to a length or distance (e.g., a length of about 10 inches), means within 10 percent above or below the referenced value (e.g., between 9 and 11 inches). As used herein, the article "a" is intended to include one or more component or element and is not intended to be construed as meaning only one.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. An expansion joint configured to cover a gap between a first architectural surface and a second architectural surface, comprising:

a panel;

a subframe coupled to the panel, the subframe comprising a plurality of beams extending in a lateral direction and spaced apart from each other in a transverse direction;

a first mounting joint configured to attach to the first architectural surface, the first mounting joint comprising a first mounting frame;

a second mounting joint configured to attach to the second architectural surface, the second mounting joint comprising:

a coupling member;

a second mounting frame; and a clamping arm coupled to the second mounting frame;

wherein the second mounting frame and the clamping arm are configured to releasably couple to the coupling member; and wherein each of the coupling member, the second mounting frame, and the clamping arm, respectively, are continuous integrally formed components that extend to each of the plurality of beams.

2. The expansion joint of claim 1, the second mounting joint being fabricated from aluminum.

3. The expansion joint of claim 2, wherein each of the coupling member, the second mounting frame, and the clamping arm are fabricated from aluminum.

4. The expansion joint of claim 1, wherein the panel is fabricated from a material selected from the group consisting of: resin coated composite material; metal alloy; wood; and asphalt shingle.

5. The expansion joint of claim 1, wherein the first mounting frame is a continuous integrally formed component that extends to each of the plurality of beams.

6. The expansion joint of claim 5, wherein the first mounting frame is fabricated from aluminum.

7. The expansion joint of claim 1, wherein the coupling member comprises a convex arcuate surface having a radius of curvature, and the clamping arm and the second mounting frame each comprise a concave arcuate surface corresponding to the radius of curvature of the convex arcuate surface.

8. The expansion joint of claim 1, wherein the first architectural surface and the second architectural surface are roof sections.

9. The expansion joint of claim 1, wherein the coupling member directly contacts the subframe.

10. An expansion joint configured to cover a gap between a first architectural surface and a second architectural surface, comprising:

a panel;

a subframe coupled to the panel, the subframe comprising a plurality of beams extending in a lateral direction and spaced apart from each other in a transverse direction;

a first mounting joint configured to attach to the first architectural surface, the first mounting joint comprising a first mounting frame;

a second mounting joint comprising:

a coupling member coupled to the subframe;

a second mounting frame configured to attach to the second architectural surface; and a clamping arm rotatably coupled to the second mounting frame; and wherein each of the coupling member, the second mounting frame, and the clamping arm, respectively, are continuous integrally formed components that extend to each of the plurality of beams.

11. The expansion joint of claim 10, wherein each of the coupling member, the second mounting frame, and the clamping arm are fabricated from aluminum.

12. The expansion joint of claim 10, wherein the panel is fabricated from a material selected from the group consisting of: resin coated composite material; metal alloy; wood; and asphalt shingle.

13. The expansion joint of claim 10, wherein the first mounting frame is a continuous integrally formed component that extends to each of the plurality of beams.

14. The expansion joint of claim 10, wherein the coupling member comprises a convex arcuate surface having a radius of curvature, and the clamping arm and the second mounting frame each comprise a concave arcuate surface corresponding to the radius of curvature of the convex arcuate surface.

15. The expansion joint of claim 10, wherein the first architectural surface and the second architectural surface are roof sections.

16. An expansion joint configured to cover a gap between a first architectural surface and a second architectural surface, comprising:

a panel;

a subframe coupled to the panel, the subframe comprising a plurality of beams extending in a lateral direction and spaced apart from each other in a transverse direction;

a first mounting joint configured to attach to the first architectural surface, the first mounting joint comprising a first mounting frame;

a second mounting joint configured to attach to the second architectural surface, the second mounting joint comprising:

a coupling member;

a second mounting frame; and a clamping arm coupled to the second mounting frame;

wherein each of the coupling member, the second mounting frame, and the clamping arm, respectively, are continuous integrally formed components that extend to each of the plurality of beams;

wherein the expansion joint is adjustable between a closed position and a disengaged position;

wherein, when the expansion joint is in the closed position, the coupling member is releasably coupled to the second mounting frame and clamping arm such that the subframe is coupled to each of the coupling member, the second mounting frame, and the clamping arm; and wherein, when the expansion joint is in the disengaged position, the coupling member is capable of movement relative to the second mounting frame and the clamping arm.

17. The expansion joint of claim 16, wherein the first mounting frame is a continuous integrally formed component that extends to each of the plurality of beams.

18. The expansion joint of claim 17, wherein the first mounting frame defines a rotational axis; and wherein, when the expansion joint is in the disengaged position, the subframe is configured to rotate about the rotational axis.

19. The expansion joint of claim 16, wherein the coupling member comprises a convex arcuate surface having a radius of curvature, and the clamping arm and the second mounting frame each comprise a concave arcuate surface corresponding to the radius of curvature of the convex arcuate surface.

20. The expansion joint of claim 16, wherein the coupling member directly contacts the subframe.

* * * * *